US006471564B1

(12) United States Patent
Coleman et al.

(10) Patent No.: US 6,471,564 B1
(45) Date of Patent: Oct. 29, 2002

(54) SPLATTLE PADDLE

(76) Inventors: Thomas J. Coleman, 19170 Paddock Pl., Abingdon, VA (US) 24211; William K. Schlotter, IV, 117 Wateredge La., Fredericksburg, VA (US) 22406; Princess Ann Coleman, 19170 Paddock Pl., Abingdon, VA (US) 24211; Ann M. Schlotter, 117 Wateredge La., Fredericksburg, VA (US) 22406

( * ) Notice: Subject to any disclaimer, the term of this patent is extended or adjusted under 35 U.S.C. 154(b) by 0 days.

(21) Appl. No.: 10/003,181

(22) Filed: Dec. 6, 2001

(51) Int. Cl.[7] ..... A63H 23/08; A63H 3/52

(52) U.S. Cl. ..... 446/267; 446/266; 473/588; 473/526; 473/505; 473/530; 473/514; 473/528; 273/412; 273/330; 482/110

(58) Field of Search ..... 446/267; 273/330

(56) References Cited

U.S. PATENT DOCUMENTS 2,250,802 A * 7/1941 Johnston
3,643,948 A * 2/1972 Coates ..... 273/97
4,131,278 A * 12/1978 Goldenberg ..... 273/67 R
4,212,460 A * 7/1980 Kraft ..... 273/58 B
4,222,563 A * 9/1980 Heftler et al. ..... 273/67 R
4,272,076 A * 6/1981 Song et al. ..... 273/58 C
5,080,374 A * 1/1992 Yu ..... 273/346
5,160,147 A * 11/1992 Ping ..... 273/346
5,188,359 A * 2/1993 Wu ..... 273/67 R
5,217,222 A * 6/1993 Rudell et al. ..... 273/67 R
5,249,810 A * 10/1993 Cazalet ..... 273/330
5,253,874 A * 10/1993 Hoffman ..... 273/346
5,261,673 A * 11/1993 Miller ..... 273/346
5,405,149 A * 4/1995 Allen ..... 273/330
6,062,993 A * 5/2000 Rodriguez ..... 473/424

* cited by examiner

*Primary Examiner*—Derris H. Banks
*Assistant Examiner*—Ali Abdelwahed
(74) *Attorney, Agent, or Firm*—Melvin L. Crane

(57) ABSTRACT

The splattle paddle comprises a main housing with a handle secured thereto. A stretchable, flexible material is secured at an outer edge to the main housing. A button is secured centrally of the main housing to which one end of a linear stretchable cord is secured. The opposite end of the cord is secured to a holding apparatus, such as a clip. In use, a water-filled balloon or ball is secured to the holding apparatus and the water-filled balloon is then hit by the paddle until the balloon breaks.

6 Claims, 1 Drawing Sheet

SPLATTLE PADDLE

BACKGROUND OF THE INVENTION

This invention is directed to a splattle paddle as set forth in a disclosure document filed May 11, 2001.

The device sets forth a paddle to which a stretchable cord is secured at one end and the opposite end of the cord is secured to a holding means to which a mouth end of a balloon is secured.

PRIOR ART

Heretofore a paddle in combination with a rubber ball attached to a stretchable band has been available for use. The band is secured at one end to a center point of the paddle with the opposite end of the band secured to the ball. The ball is then hit by the paddle for as many times as possible before the ball is not hit by the paddle. Also, U.S. Pat. No. 4,212,460 relates to a water-filled game toy.

SUMMARY OF THE INVENTION

It is therefore an object of the invention to provide a paddle in combination with a balloon. The balloon is filled with water or used without water therein, and the game, is to hit the balloon with the paddle as many times as possible before bursting the balloon.

Another object is to fill a balloon with water, or without water, and to see how high you can hit the balloon which is not attached to the paddle with a stretchable band.

Still another object is to attach a water ball to the paddle with a stretchable band and see how many times one can hit the ball before the ball bursts.

Other objects and advantages of the invention will become obvious to those skilled in the art upon a review of the drawings, specification and claims.

DETAILED DESCRIPTION OF THE INVENTION

Figures 1, 2:
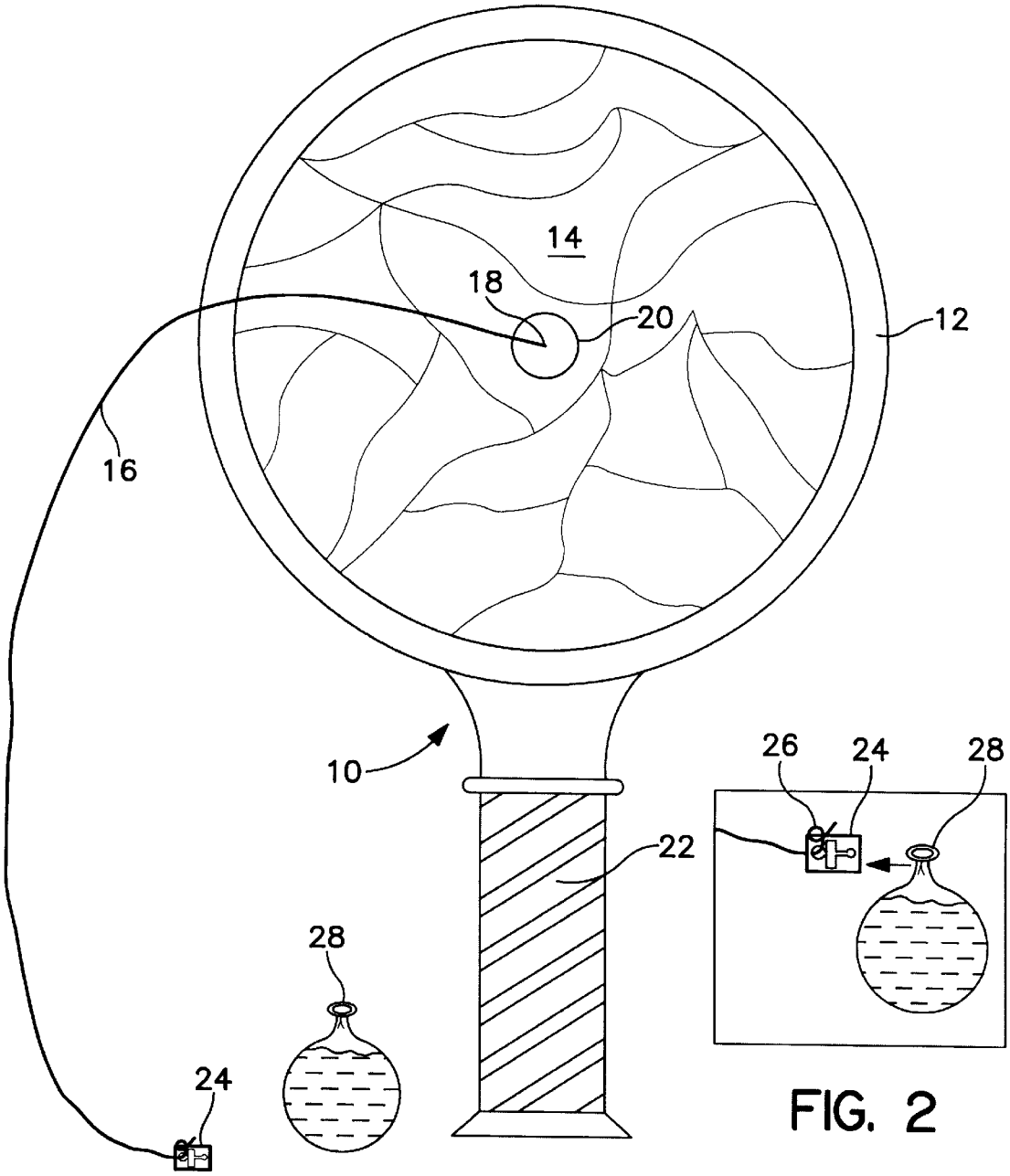
FIG. 1 illustrates a paddle with one end of a stretchable cord secured thereto with another end of the cord secured to a holding means to which the mouth end of the balloon is secured.
FIG. 2 illustrates a large view of the holding means.

Now referring to the drawings, there is shown a paddle 10 which includes a circular main housing 12. A stretchable, flexible material 14 is secured at its outer edge to the main housing. A stretchable flexible cord 16 is secured at one end 18 to an anchor button 20 which is secured at the center of the main housing. A handle 22 is secured to the main housing for holding in one's hand during use. The opposite end of the stretchable, flexible cord is secured to a holding means 24 by any suitable means which can be a knot 26 which will not slip through an opening in the holding means. The mouth end 28 of a balloon which can be water filled or filled with air is secured to the holding means 24 to which the stretchable, flexible cord is attached. The end of the balloon can be secured by any suitable means such as a knot or a closure clip.

In use for playing a game, the balloon is filled at least partially with water and secured to the means 24 to which the stretchable, flexible cord has been attached. With the opposite end of the cord secured to the paddle, the balloon is then hit by the paddle to see how many times the balloon can be hit before the balloon bursts. Players can take turns by using different balloons since the idea is for each player to burst the balloon.

A game could be played by different players in which the balloon is not secured to the cord. The object would be to see which player can hit the balloon the highest without bursting the balloon. In such a game the cord need not be secured to the paddle. That is, only the paddle and balloon are necessary. The game could be played with a water balloon/ball or one without water therein.

The foregoing relates to preferred exemplary embodiments of the invention, it being understood that other variants and embodiments thereof are possible within the spirit and scope of the invention, the latter being defined by the appended claims.

We claim:

1. A splattle paddle comprising a main housing, a handle secured to and extending from the main housing, a stretchable, flexible material secured to the main housing within an inner surface of the main housing, an anchor means centrally located on the stretchable, flexible material, a stretchable, flexible cord, a holding means, one end of the cord is secured to the anchor means and another end of the cord is secured to the holding means, and a burstable means for filling with water which is secured to said holding means and is bounced by the splattle paddle.

2. A splattle paddle as set forth in claim 1, in which the burstable means is a balloon.

3. A splattle paddle as set forth in claim 2, in which the balloon is at least partially filled with water.

4. A splattle paddle as set forth in claim 3, in which the balloon is filled with water.

5. A splattle paddle as set forth in claim 2, in which the burstable means is a balloon filled with air.

6. A splattle paddle as set forth in claim 1, in which the main housing is a ring shape, and the stretchable, flexible material is secured within the main housing in a normal non-stretched condition of the material.

* * * * *